US011725335B2

(12) United States Patent
Lee et al.

(10) Patent No.: US 11,725,335 B2
(45) Date of Patent: Aug. 15, 2023

(54) SYSTEM IRON

(71) Applicant: LG ELECTRONICS INC., Seoul (KR)

(72) Inventors: Youngjoo Lee, Seoul (KR); Yongju Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 511 days.

(21) Appl. No.: 16/474,649

(22) PCT Filed: Dec. 29, 2017

(86) PCT No.: PCT/KR2017/015705

§ 371 (c)(1),
(2) Date: Sep. 20, 2021

(87) PCT Pub. No.: WO2018/124801

PCT Pub. Date: Jul. 5, 2018

(65) Prior Publication Data

US 2021/0404111 A1 Dec. 30, 2021

(30) Foreign Application Priority Data

Dec. 30, 2016 (KR) ..... 10-2016-0184192

(51) Int. Cl.
*D06F 81/08* (2006.01)
*D06F 81/04* (2006.01)

(52) U.S. Cl.
CPC ..... *D06F 81/08* (2013.01); *D06F 81/04* (2013.01)

(58) Field of Classification Search
CPC ..... D06F 81/00; D06F 81/12
See application file for complete search history.

(56) References Cited

U.S. PATENT DOCUMENTS 656,256 A * 8/1900 Leisenring ..... A47B 23/046 248/397
3,397,472 A * 8/1968 Topliffe ..... D06F 81/08 38/104

(Continued)

FOREIGN PATENT DOCUMENTS

CN 101213338 7/2008
CN 103074756 5/2013

(Continued)

OTHER PUBLICATIONS

European Search Report dated Jul. 27, 2020.

(Continued)

*Primary Examiner* — Ismael Izaguirre
(74) *Attorney, Agent, or Firm* — Birch, Stewart, Kolasch & Birch, LLP

(57) ABSTRACT

The present invention relates to a system iron. The system iron according to the present invention includes a body including a steam generator for generating steam; an ironing plate, which is rotatably coupled to an upper portion of the body and which sprays the steam generated by the steam generator to an outside; an angle-limiting member for limiting rotation of the ironing plate; a button unit, which is operated in linkage with the angle-limiting unit so as to release a state in which the rotation of the ironing plate is limited by the angle-limiting unit; and an elastic member for maintaining the state in which the rotation of the ironing plate is limited by the angle-limiting unit.

8 Claims, 17 Drawing Sheets

(56) References Cited

U.S. PATENT DOCUMENTS

| | | | | |
|---|---|---|---|---|
| 7,396,233 | B2 * | 7/2008 | Lin | F16M 11/10 439/31 |
| 8,266,830 | B2 * | 9/2012 | Ma | D06F 81/02 38/139 |
| 2007/0095257 | A1 | 5/2007 | Hernandez | |
| 2010/0242317 | A1 * | 9/2010 | Trowsdale | D06F 81/08 38/103 |

FOREIGN PATENT DOCUMENTS

| | | | | |
|---|---|---|---|---|
| CN | 103314153 | | 9/2013 | |
| CN | 106103835 | | 11/2016 | |
| EP | 1550765 | A1 * | 7/2005 | D06F 81/006 |
| EP | 1 602 777 | | 12/2005 | |
| JP | 9-122399 | | 5/1997 | |
| KR | 10-2004-0063896 | | 7/2004 | |
| KR | 10-1150509 | | 5/2012 | |
| KR | 10-2013-0045209 | | 5/2013 | |
| KR | 10-1292016 | | 8/2013 | |
| KR | 10-2013-0124350 | | 11/2013 | |
| WO | WO 2007/004135 | A1 | 1/2007 | |
| WO | WO-2007057419 | A1 * | 5/2007 | D06F 81/003 |
| WO | WO 2016/124705 | A1 | 8/2016 | |

OTHER PUBLICATIONS

PCT Search Report dated Dec. 30, 2016.
Chinese Office Action in Chinese Application No. 201780087702.X dated Mar. 12, 2021 (7 pages).

* cited by examiner (a)

(b)

SYSTEM IRON

CROSS-REFERENCE TO RELATED APPLICATIONS

This application is a U.S. National Phase entry under 35 U.S.C. § 371 from PCT International Application No. PCT/KR2017/015705, filed Dec. 29, 2017, which claims priority to Korean Application No. 10-2016-0184192, filed Dec. 30, 2016, the contents of all of which are incorporated herein by reference in their entireties.

TECHNICAL FIELD

The present invention relates to a system iron, and more particularly to a system iron capable of controlling an angle of an ironing plate.

BACKGROUND ART

In wrinkle removal from clothing, there are the case in which ironing using an iron is required and the case in which garment steaming is required, depending on the type of clothing. However, there is a problem in that wrinkle removal is troublesome because different devices have to be used as needed.

In addition, there is also a problem of troublesome in which a top such as a dress shirt, which is closed by buttons, has to be buttoned up again on a garment steamer before being held on the garment steamer in the case of performing garment steaming.

Although Korean Unexamined Patent Publication Nos. 10-2016-0066224 and 10-2012-0018486 disclose steaming apparatuses in which steam is sprayed inside clothing, there is a problem in that the steaming apparatuses cannot perform an ironing operation using an iron.

Furthermore, because the above steaming apparatus cannot be used in the state in which the position of the ironing plate is changed, it is impossible to consider a solution for changing the position of the ironing plate or for stably maintaining the ironing plate in the state of being changed in the position thereof.

RELATED ART DOCUMENT

Patent Documents

Korean Unexamined Patent Publication No. 10-2016-0066224A

Korean Unexamined Patent Publication No. 10-2012-0018486A

DISCLOSURE

Technical Problem

An object to be accomplished by the present invention is to provide a system iron capable of performing a wrinkle removal operation in various ways.

Another object to be accomplished by the present invention is to provide a system iron capable of stably maintaining the position of an ironing plate.

A further object to be accomplished by the present invention is to provide a system iron capable of positioning the ironing plate at various angles.

Technical Solution

The system iron according to the present invention includes a body including a steam generator for generating steam; an ironing plate rotatably disposed on the body and spraying the steam, which is generated by the steam generator, to an outside thereof, a top being hung on an outer side of the ironing plate; a spreading unit for tensioning the top hung on the outer side of the ironing plate; a front press for holding a front surface of the top, which is hung on the outer side of the ironing plate; and a pair of arm tensioners for tensioning the sleeves of the top, which is hung on the outer side of the ironing plate, whereby it is possible to perform ironing using an iron and steam spraying and to easily hold the front surface of the top by means of the front press.

The system iron according to the present invention includes a body including a steam generator for generating steam; an ironing plate, which is rotatably coupled to an upper portion of the body and which sprays the steam generated by the steam generator to an outside; an angle-limiting member for limiting the rotation of the ironing plate; a button unit, which is operated in linkage with the angle-limiting unit so as to release the state in which rotation of the ironing plate is limited by the angle-limiting unit; and an elastic member for maintaining the state in which the rotation of the ironing plate is limited by the angle-limiting unit, whereby it is possible to maintain the ironing plate, which is rotatably coupled to the upper portion of the body, at a predetermined angle on the upper portion of the body.

The system iron further includes a hinge shaft connecting the ironing plate to an upper portion of the body in a rotatable manner; a connecting bar connecting the hinge shaft to the ironing plate; and a locking bar, which is disposed on the body so as to support the rotation of the hinge shaft and which has a locking groove into which the angle-limiting member is inserted. The locking bar includes, at one end thereof, a locking ring having a hollow cavity so as to be connected to the hinge shaft, and the locking ring includes, in an outer periphery thereof, an ironing-mode-locking groove into which the locking projection of the angle-limiting member is inserted for an ironing mode using an iron; a steam-mode-locking groove into which the locking projection of the angle-limiting member is inserted for an steam-spraying mode using a steam; and at least one additional locking groove provided between the ironing-mode-locking groove and the steam-spraying-mode-locking groove, whereby it is possible to position the ironing plate at various angles on the upper portion of the body.

Advantageous Effects

First, since the system iron according to the present invention is able to perform both ironing using an iron and garment steaming by means of a single apparatus, there is an advantage in that it is possible to use a single apparatus to perform various ironing operations as required by a user.

Second, since, in the system iron according to the embodiment, an elastic member is connected to the angle-limiting member to limit the rotation of the hinge shaft, there is an advantage in that it is possible to stably maintain the position of the ironing plate.

Third, since the system iron according to the embodiment is able to position the ironing plate at various angles on the upper portion of the body, there is an advantage in that it is possible to position the ironing plate as required by a user.

BEST MODE

Figure 1:
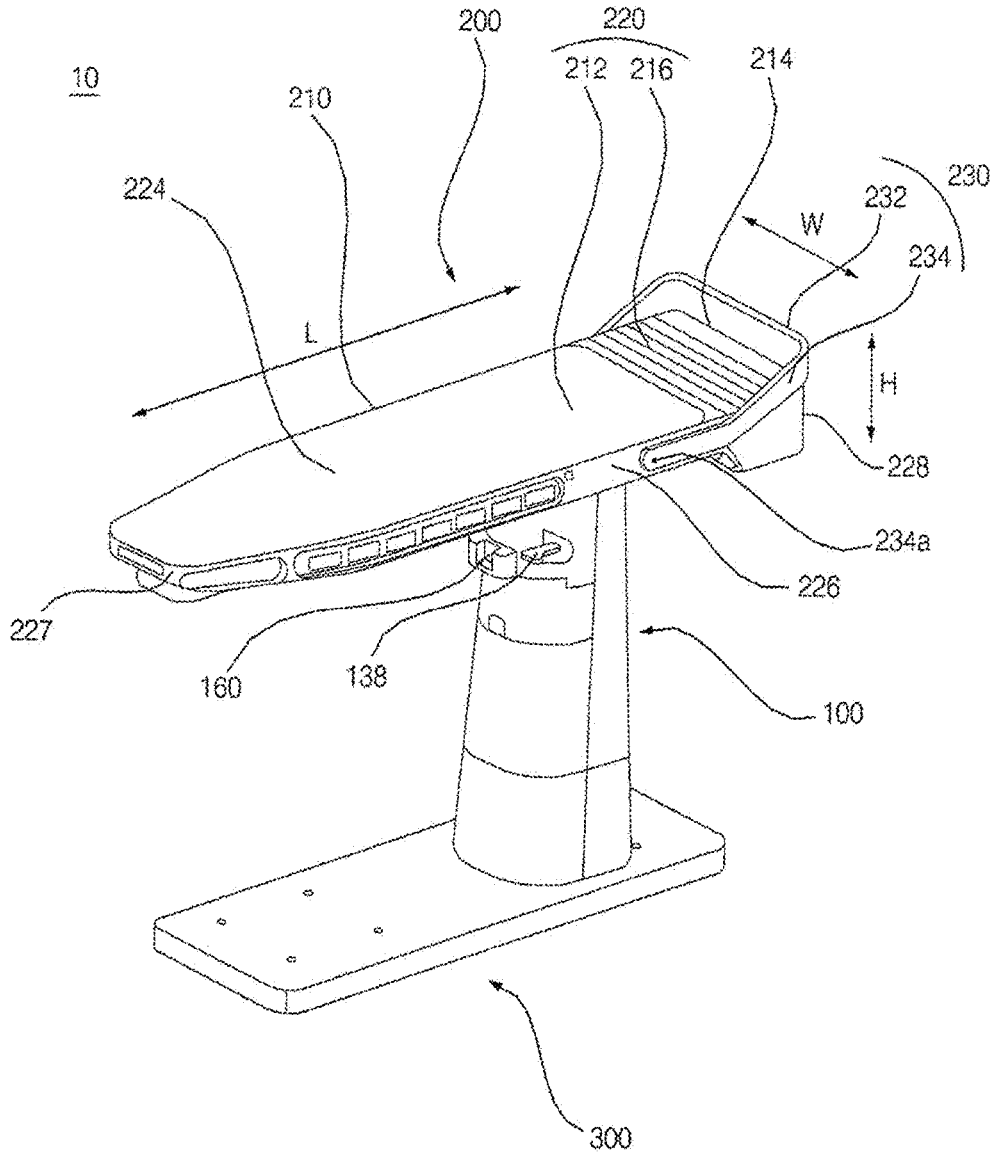
FIG. 1 is a perspective view of a system iron according to an embodiment of the present invention in an ironing mode.

Hereinafter, the present invention will be described with reference to the drawings, which are provided to illustrate a system iron according to embodiments of the present invention.

The system iron 10 according to an embodiment of the present invention includes a body 100 including a steam generator for generating steam; an ironing plate 200 rotatably disposed on the body, on an outer side of which a top is hung and which sprays the steam generated by the steam generator; a spreading unit for tensioning the top hung on the outer side of the ironing plate; a front press 260 for holding the front surface of the top hung on the outer side of the ironing plate; and a pair of arm tensioners 270 for tensioning the sleeves of the top hung on the outer side of the ironing plate.

The system iron 10 according to the embodiment includes a body 100 including therein a steam generator for generating steam; an ironing plate 200 rotatably disposed on the body so as to be changed in position depending on whether the system iron is operated in an ironing mode, in which an ironing operation is performed or in a steam-spraying mode, in which the steam is sprayed to a top; a spreading unit for tensioning the top hung on the outer side of the ironing plate in the steam-spraying mode; a front press 260 for holding the front surface of the top hung on the outer side of the ironing plate in the steam-spraying mode; and a pair of arm tensioners 270 for tensioning the sleeves of the top hung on the outer side of the ironing plate in the steam-spraying mode.

Figure 2:
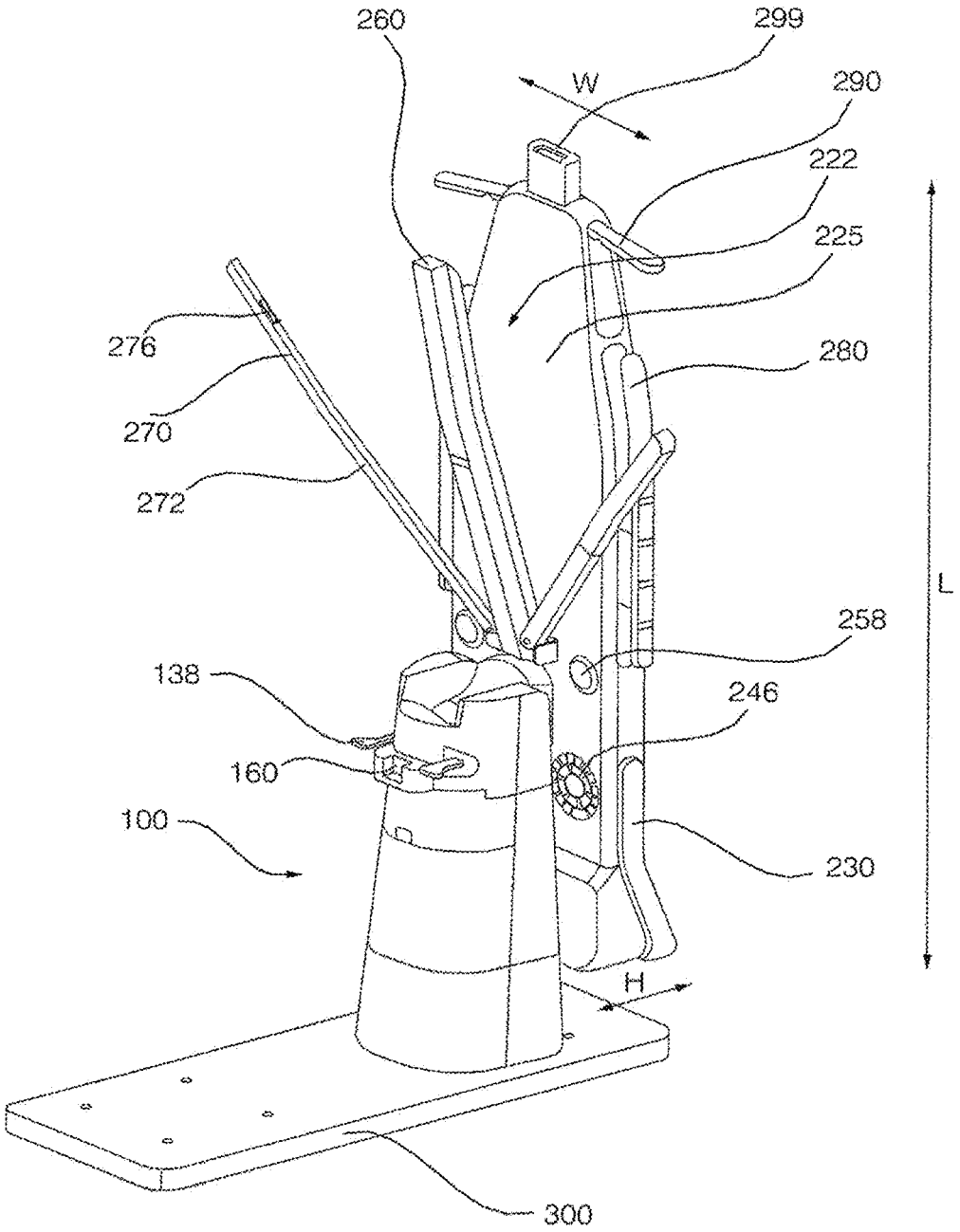
FIG. 2 is a perspective view of the system iron according to an embodiment of the present invention in a steam-spraying mode.
Figure 3:
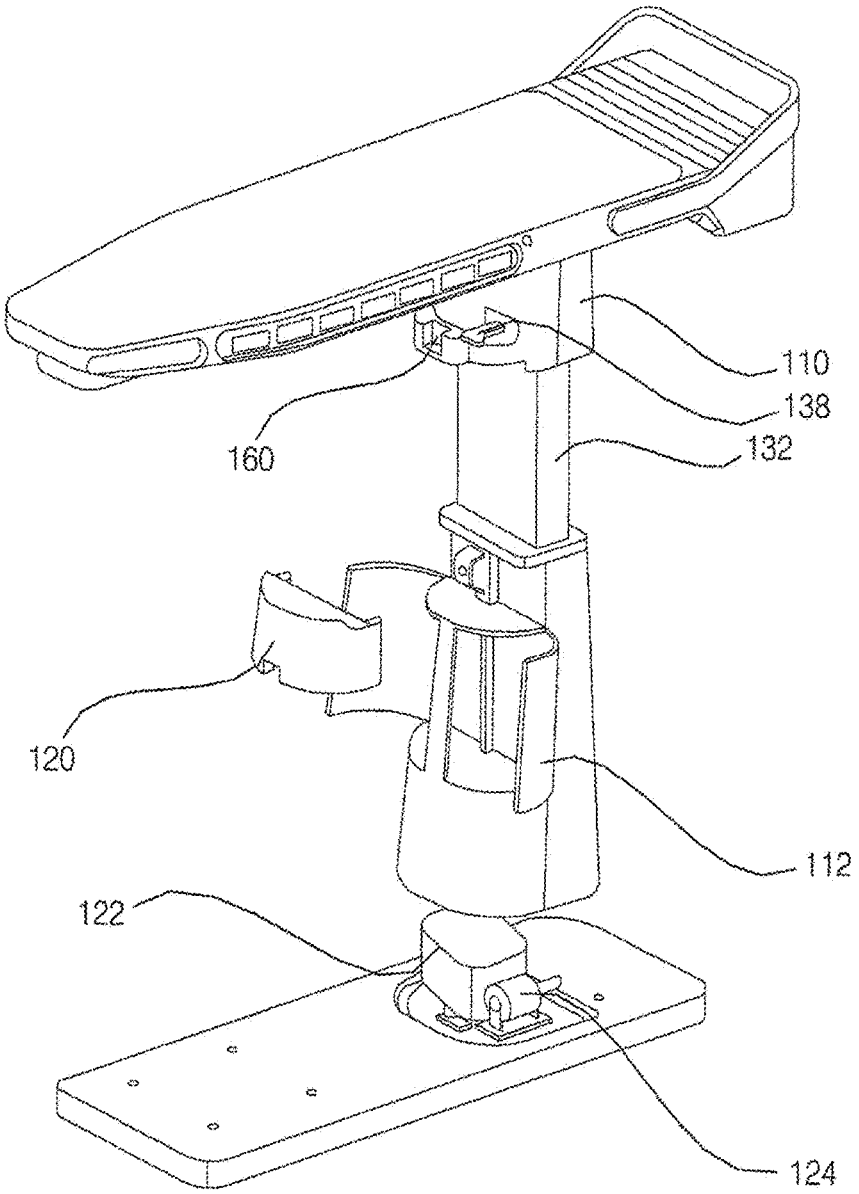
FIG. 3 is an exploded view of the body of the system iron according to an embodiment of the present invention.
Figure 4:
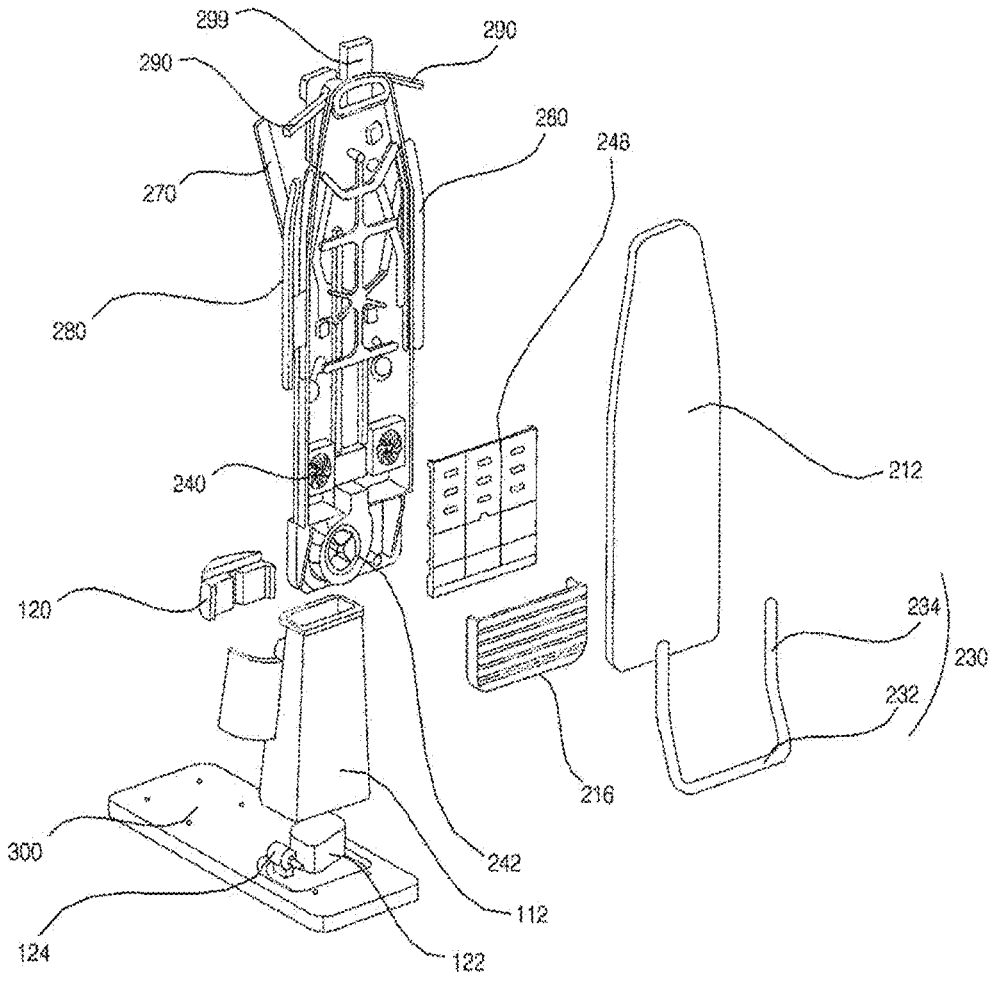
FIG. 4 is an exploded view of the system iron according to an embodiment of the present invention.
Figure 5:
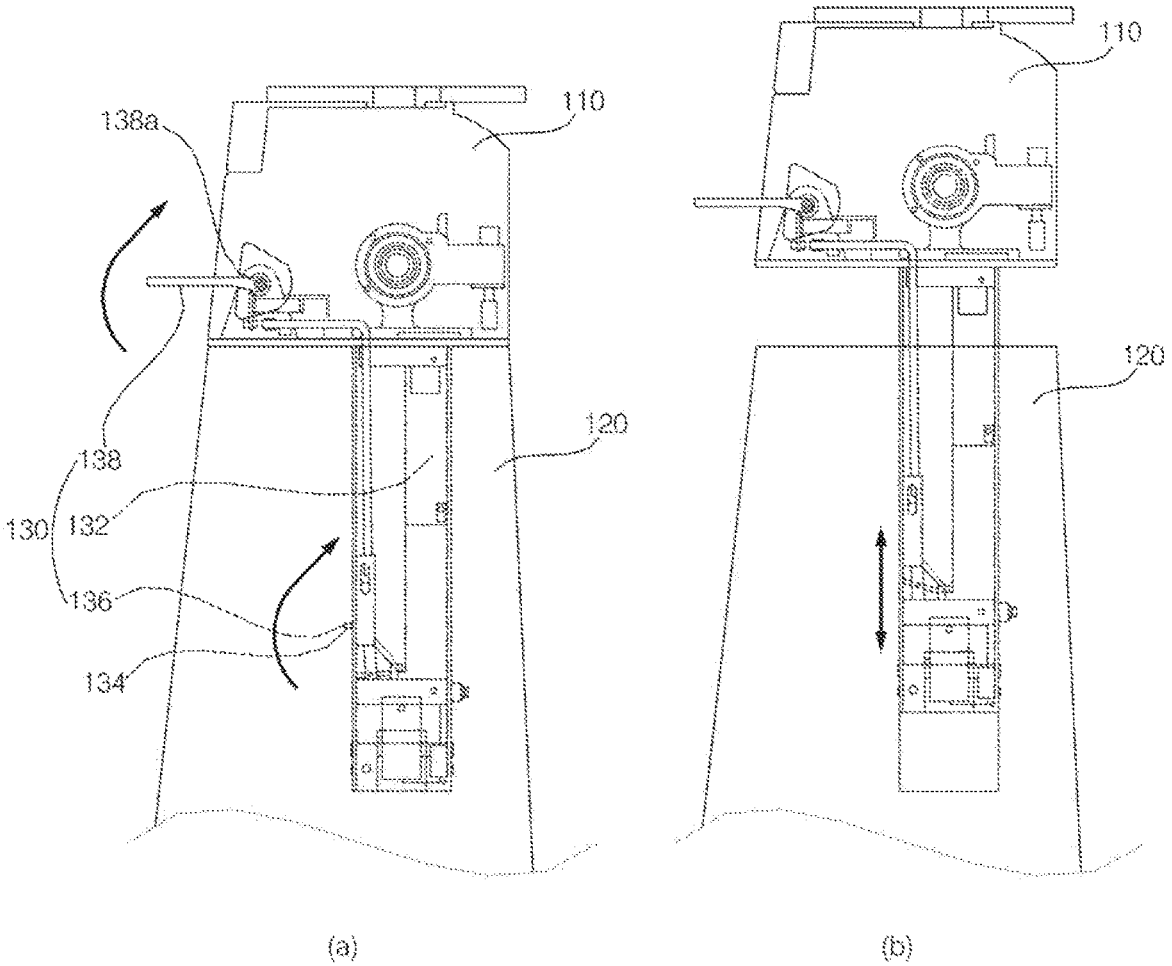
FIG. 5 is a view illustrating a height adjustment unit of the system iron according to an embodiment of the present invention, in which (a) illustrates the state in which an ironing plate is locked and (b) illustrates the state in which the ironing plate is movable.

FIG. 1 is a perspective view of the system iron according to an embodiment of the present invention in an ironing mode. FIG. 2 is a perspective view of the system iron according to an embodiment of the present invention in a steam-spraying mode. FIG. 3 is an exploded view of the body of the system iron according to an embodiment of the present invention. FIG. 4 is an exploded view of the system iron according to an embodiment of the present invention. FIG. 5 is a view illustrating a height adjustment unit of the system iron according to an embodiment of the present invention.

The body of the system iron according to the embodiment will first be described with reference to FIGS. 1 to 5.

The body 100 supports the ironing plate 200, which is connected to the upper side thereof. The body 100 according to the embodiment may be disposed so as to be perpendicular to the ground surface.

The body 100 is configured to have a cylindrical shape, the sectional area of which is decreased moving upwards.

The body 100 includes an upper body 110, to which a rotational member 430 is rotatably connected, and a lower body 112 for accommodating therein a water tank 120 and the steam generator. The upper body 110 and the lower body 112 are disposed such that the lower surface of the upper body 110 is in contact with the upper surface of the lower body 112. The lower surface of the upper body 110 and the upper surface of the lower body 112 may be disposed so as to be spaced apart from each other by means of the height adjustment unit 130.

The rotational member 430 of the ironing plate 200 is rotatably coupled to the upper side of the upper body 110. The upper body 110 is provided at the upper side thereof with two locking bars 410 for supporting the rotation of a hinge shaft disposed in the rotational member 430. The locking bars 410 are provided therein with circular cavities, in which the hinge shaft 432 is disposed.

The body 100 includes the water tank 120, the steam generator 122 for producing steam from the water stored in the water tank 120, and a vibration pump 124 for supplying the water from the water tank 120 to the steam generator 122. The lower body 112 includes the water tank 120, the steam generator and the vibration pump 124.

The water tank 120 is the space for storing water for generating steam. The water tank 120 is constructed so as to be releasably attached to the body 100. The water tank 120 may be filled with water when separated from the system iron and may then be fitted into the body 100.

The steam generator 122 is a device for generating steam from the water stored in the water tank 120. Some of the water stored in the water tank 120 is introduced into the steam generator 122 by virtue of vibration of the vibration pump 124.

The body 100 according to the embodiment includes therein a steam flow channel 244, which allows steam, generated by the steam generator, to flow to steam nozzles 245 in the ironing plate 200. The steam flow channel 244 according to the embodiment is positioned in the body 100 and the ironing plate 200.

The steam flow channel 244, which is positioned in the system iron according to the embodiment, may be divided into a body steam flow channel, which is positioned in the body, and an ironing plate steam flow channel, which is positioned in the ironing plate. The body steam flow channel and the ironing plate steam flow channel are connected to each other. Steam, which is generated by the steam generator, flows through the body steam flow channel and the ironing plate steam flow channel, and is then discharged from the steam nozzles 245. The steam nozzles 245 are disposed inside the spreading unit of the ironing plate 200. When the spreading unit is spread out to the outside of the ironing plate, the steam nozzles 245 spray steam to the outside.

The body 100 includes the height adjustment unit 130 for adjusting the height of the ironing plate 200. The height adjustment unit 130 adjusts the height of the ironing plate 200 by raising or lowering the upper body 110.

The height adjustment unit 130 includes a height adjustment box 132, which is retracted into the body 100 or is extended to the outside of the body 100 so as to adjust the height of the ironing plate 200, a locking unit 136 for restricting the movement of the height adjustment box 132 and a height adjustment lever 138, which is operated in linkage with the locking unit 136 so as to allow the height adjustment box 132 to be moved.

The height adjustment box 132 according to the embodiment is configured to have a cuboid box shape. The height adjustment box 132 is disposed under the upper body 110. The height adjustment box 132 is retracted into the lower body 112, or is extended upwards from the lower body 112. The height adjustment box 132 is moved upwards and downwards between the outside and the inside of the lower body 112. When the height adjustment box 132 is moved upwards and downwards, the upper body 110 and the ironing plate 200, which are disposed above the height adjustment box 132, are also moved upwards and downwards together with the height adjustment box 132.

The height adjustment box 132 is provided therein with the locking unit 136 for restricting the upward and downward movement of the height adjustment box 132. The height adjustment box 132 is provided in a side surface thereof with a projection hole 134 such that a part of the locking unit 136 projects outwards from the height adjustment box 132 through the projection hole 134.

The locking unit 136 serves to restrict the movement of the height adjustment box 132. The locking unit 136 may be disposed in the height adjustment box 132, and a part of the locking unit 136 may project through the projection hole 134 in the height adjustment box 132. When a projection member of the locking unit 136 projects outwards from the height adjustment box 132, the projection member is engaged with one side of the accommodation space in the height adjustment box 132 at a low position of the body 100, thereby restricting the movement of the height adjustment box 132.

When the part of the locking unit 136 projects outwards through the projection hole 134 in the height adjustment box 132, the height adjustment unit 130 is maintained in the locked state, thereby restricting the upward and downward movement of the height adjustment box 132. When the projection member of the locking unit 136 does not project outwards through the projection hole 134 in the height adjustment box 132, the height adjustment unit 130 is released from the locked state, thereby allowing upward and downward movement of the height adjustment box 132.

The locking unit 136 is operated in linkage with the height adjustment lever 138. A user may switch the height adjustment unit 130 between the locked state and the released state using the height adjustment lever 138. A user may cause the projection member of the locking unit to project outwards from the height adjustment box 132 or to be retracted into the height adjustment box 132 using the height adjustment lever 138. A user may move the height adjustment box 132 using the height adjustment lever 138.

The height adjustment lever 138 is disposed at the upper body 110. The height adjustment lever 138 may be connected to the locking unit 136. The height adjustment lever 138 may cause the projection member of the locking unit 136 to project to the outside of the height adjustment box 132 or to be disposed in the height adjustment box 132 using a wire.

The height adjustment unit 130 according to the embodiment is constructed such that, when the height adjustment lever 138 is rotated upwards about a lever shaft 138*a* as shown in FIG. 5(*a*), the locking unit 136 is released, thereby allowing the height adjustment box 132 to be moved upwards and downwards as shown in FIG. 5(*b*).

The body according to the embodiment includes the support-leg mount 160, on which a support leg 266 (see FIG. 11) of a support unit of the ironing plate 200, which will be described later, is mounted. The support-leg mount 160 is the portion formed at the upper body 110, on which one end of the support leg 266 is mounted.

Figure 6:
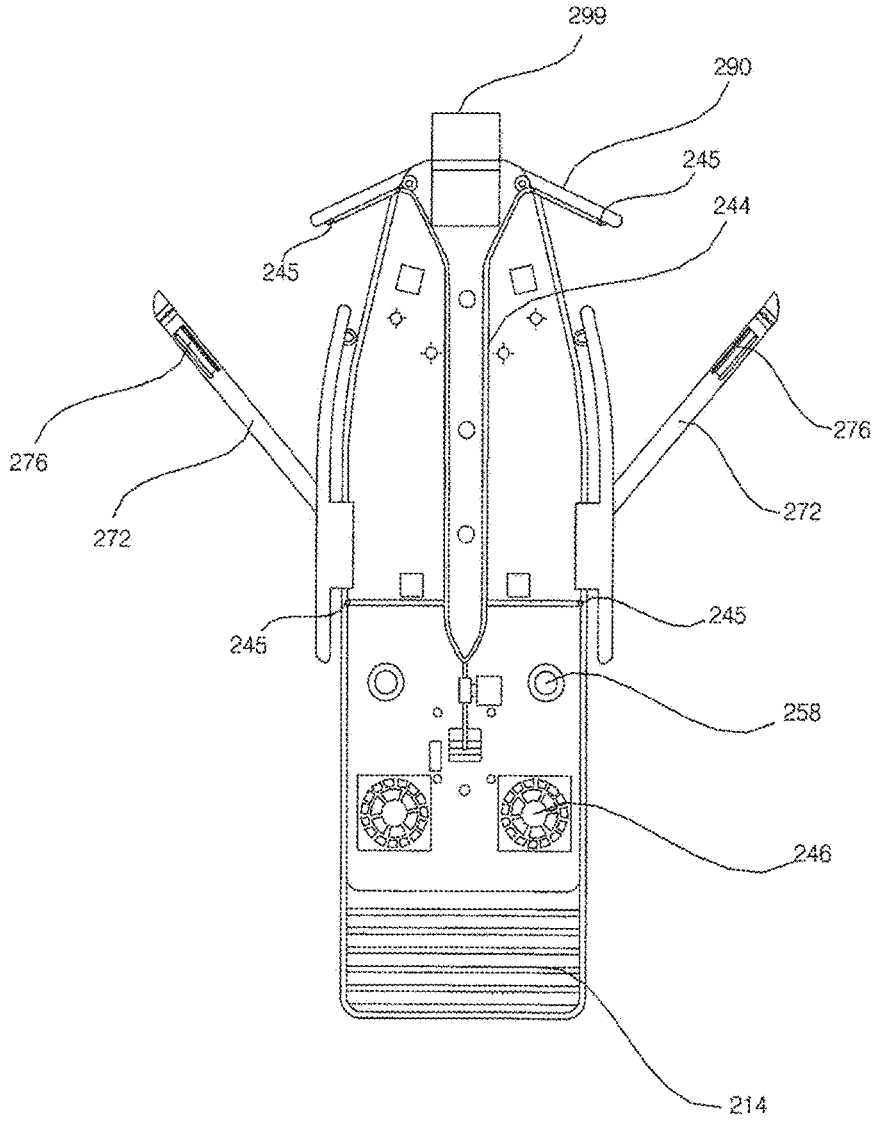
FIG. 6 is a view showing a planar surface of the ironing plate from which a clothing-ironing plate and a first fan have been removed in order to show the steam flow channel and the steam nozzles of the system iron according to an embodiment of the present invention.
Figure 7:
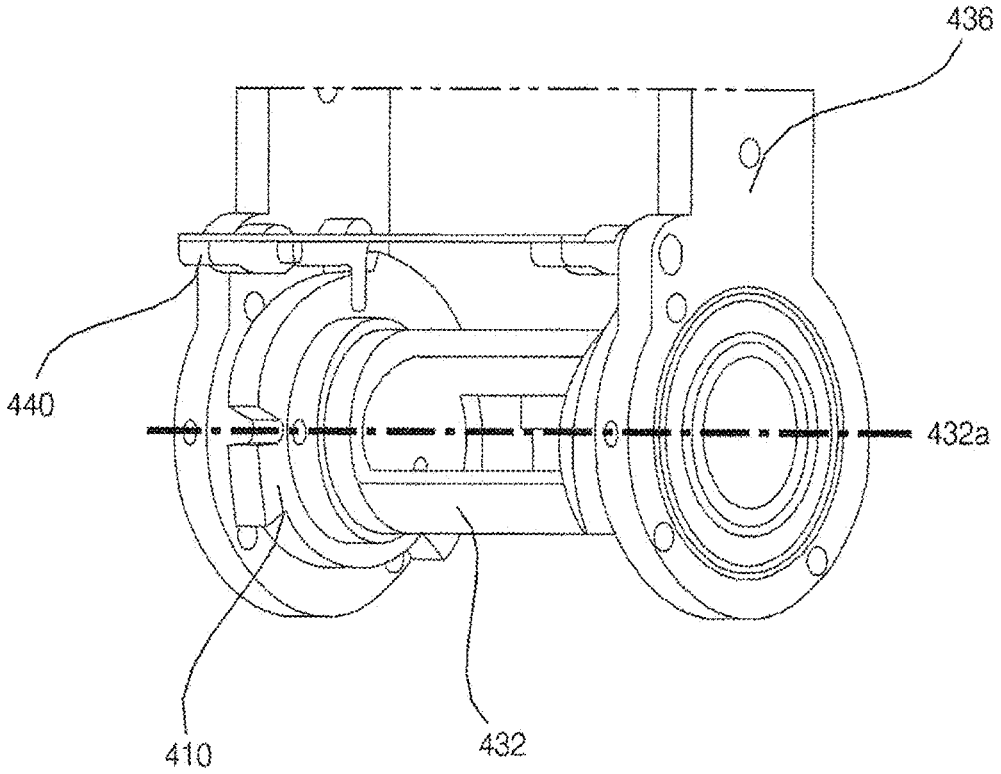
FIG. 7 is a view illustrating a hinge shaft and an angle-limiting member in the rotational member, which are intended to rotate or lock the ironing plate of the system iron according to an embodiment of the present invention.

FIG. 6 is a view showing the planar surface of the ironing plate from which a clothing-ironing plate and a first fan are removed in order to show the steam flow channel and the steam nozzles of the system iron according to an embodiment of the present invention. FIG. 7 is a view illustrating a hinge shaft and an angle-limiting member in the rotational member, which are intended to rotate or lock the ironing plate of the system iron according to an embodiment of the present invention.

Hereinafter, the ironing plate of the system iron will be described with reference to FIGS. 1 to 4, FIG. 6 and FIG. 7.

The ironing plate 200 according to the embodiment is a plate functioning to iron clothing or to spray steam on clothing hung on the outer side of the ironing plate 200. The ironing plate 200 is rotatably connected to the upper side of the body 100.

The ironing plate 200 according to the embodiment is changed in position depending on the mode in which the ironing plate 200 is used. As shown in FIG. 1, the system iron 10 according to the embodiment may be operated in the ironing mode in which clothing is ironed using an iron, as shown in FIG. 1, or in the steam-spraying mode, in which a top is hung on the outer side of the ironing plate 200 and steam is sprayed to the top hung on the ironing plate 200, as shown in FIG. 2.

The ironing plate 200 according to the embodiment is disposed parallel to the ground surface in the ironing mode and is disposed perpendicular to the ground surface in the steam-spraying mode. The ironing plate 200 according to the embodiment is disposed perpendicular to the body 100 in the ironing mode and is disposed parallel to the body 100 in the steam-spraying mode.

The ironing plate 200 according to the embodiment is rotated about a rotational axis 252*a* (see FIG. 7), which is provided at the upper portion of the upper body 110. The ironing plate 200 is rotated about the rotational axis 252*a*, which is provided at the locking bars 410 of the upper body 110, so as to be changed in position depending on whether the system iron is operated in the ironing mode or in the steam-spraying mode. The ironing plate 200 according to the embodiment is constructed so as to be rotated within a range of 0 to 90 degrees when the operational mode is changed between the ironing mode and the steam-spraying mode. However, this is merely one example, and the ironing plate 200 may be set to be rotated within an angular range of 0 to greater than 90 degrees.

In the description of the ironing plate 200 according to the embodiment, on the basis of FIG. 1, the surface of the ironing plate 200 that is connected to the body 100 is referred to as a lower surface 225, the surface of the ironing plate 200 that is opposite the lower surface 225 and on which clothing is ironed in the ironing mode is referred to as an upper surface 224, the surfaces of the ironing plate 200, on which side tensioners 280 and shoulder tensioners 290 are disposed, among the surfaces connecting the upper surface 224 and the lower surface 225, are referred to as side surfaces 226, the surface of the ironing plate 200, on which a neck clip 299 is disposed and which is adjacent to portions at which the shoulder tensioners 290 are disposed, among the surfaces connecting the upper surface 224 and the lower surface 225, is referred to as a front surface 227, and the surface of the ironing plate 200 that is opposite the front surface 227, among the surfaces connecting the upper surface 224 and the lower surface 225, is referred to as a rear surface 228.

In addition, on the basis of FIG. 1, a linear direction in which the neck clip is connected to an iron rest is referred to as a longitudinal direction L, a linear direction in which the side tensioners 280, which are disposed at the two side surfaces 226 of the ironing plate 200, are connected to each other is referred to as a cross direction W, and a linear direction in which the upper surface 220 and the lower surface 225 of the ironing plate 200 are connected to each other is referred to as a height direction H. In the longitudinal direction L, the direction toward the front surface 227 is referred to as a forward direction, and the direction opposite the forward direction and toward the lower surface 225 is referred to as a rearward direction. In the height direction H, the direction that the upper surface 224 of the ironing plate 200 faces is referred to as an upward direction, and the direction that the lower surface 225 faces is referred to as a downward direction. The longitudinal direction L, the cross direction W and the height direction H define relationships such that they are perpendicular to one another. These definitions may be used in the description of the ironing plate 200, and may be similarly used whether the operation mode is changed to the ironing mode as shown in FIG. 1 or to the steam-spraying mode as shown in FIG. 2. These definitions of direction are merely for illustration of the present invention and do not restrict the scope of the present invention.

The ironing plate 200 according to the embodiment includes an ironing-plate case 222, which defines the appearance of the ironing plate 200 and which is open at the upper plane 224, and an upper plate 220 disposed on the upper plane of the ironing plate 200. The ironing-plate case 222 and the upper plate 220 define the appearance of the ironing plate 200. The ironing-plate case 222 defines the lower surface 225, the side surfaces 226, the front surface 227 and the rear surface 228 of the ironing plate 200. The ironing-plate case 222 is coupled at the lower surface 225 to the body 100.

The upper plate 220 includes a clothing-ironing plate 212 disposed on a clothing-ironing board 210, which will be described later, and an iron-resting plate 216 disposed on an iron rest 214.

The ironing plate 200 according to the embodiment includes the clothing-ironing board 210, which is used to iron clothing in the ironing mode or on which clothing is hung in the steam-spraying mode, and the iron rest 214 on which the iron is placed in the ironing mode. The clothing-ironing board 210 is disposed at the front part of the ironing plate 200 in the longitudinal direction L, and the iron rest 214 is disposed at the rear part of the ironing plate 200 in the longitudinal direction L.

The clothing-ironing board 210 is a part on which clothing is hung so as to be ironed using an iron in the ironing mode. The clothing-ironing board 210 is a part on which clothing is hung in the steam-spraying mode. The clothing-ironing board 210 is configured so as to have a shape similar to a typical ironing plate 200 having a surface area which is reduced moving forwards in the longitudinal direction L of the ironing plate 200. The upper plane of the clothing-ironing board 210 is provided with the clothing-ironing plate 212, in which a through hole is formed so as to allow the air inside the ironing plate 200 and the air outside the ironing plate 200 to communicate with each other. The clothing-ironing board 210 is provided therein with a first fan 240, which is intended to suck air into the inside of the ironing plate 200 or to discharge air to the outside of the ironing plate 200 through the through hole formed in the clothing-ironing plate 212. The first fan 240 may be rotated in a forward direction or a reverse direction. The first fan 240 may be embodied by an axial fan.

The first fan 240 serves to suck air through the through hole in the clothing-ironing plate 212 in the ironing plate or serves to discharge air through the through hole in the clothing-ironing plate 212 in the steam-spraying mode. An opening hole 246 is formed in a lower portion of the ironing-plate case 222 so as to allow air to flow to the inside and outside of the ironing plate 200 by virtue of the first fan 240.

The clothing-ironing board 210 is provided therein with a guide plate 248 for guiding air, which flows by means of the first fan 240, toward the through hole.

The clothing-ironing board 210 includes the steam nozzles 245 for spraying steam, which is generated by the steam generator 122, toward the outside. The steam nozzles 245 receive steam, which is generated by the steam generator 122, through the steam flow channel 244. In the steam-spraying mode, steam, which is generated by the steam generator 122, is sprayed through the steam nozzles 245 disposed in the clothing-ironing board 210.

The iron rest 214 is a zone on which the iron, which is used in the ironing mode, is placed. The iron rest 214 is provided on the upper plane 224 with the iron-resting plate including a plurality of suction holes through which air flows. The iron rest 214 is provided therein with a second fan 242 so as to suck air through the plurality of holes formed in the iron-resting plate 216. The second fan 242 is preferably embodied by a sirocco fan, which causes the direction of air suction to be perpendicular to the direction of air discharge. When the second fan 242 is activated, air is sucked into the iron-resting plate 216 and is then discharged to the inside of the clothing-ironing board 210.

A silicone insulation material is disposed on the iron-resting plate 216. Accordingly, even when a high temperature iron, which is in use, is placed on the iron rest 214, it is possible to prevent a fire and contamination of the heating plate of the iron by virtue of provision of the silicone insulation material. In addition, it is possible to rapidly cool the iron, upon termination of use thereof, by activating the second fan 242 in the iron rest 214.

The ironing plate 200 may further include an iron protector 230 for preventing the iron, which is placed on the iron rest, from falling out of the iron rest. The iron protector 230 is configured so as to have a 'U' shape. The two ends of the iron protector 230 are rotatably disposed at the two side surfaces 226 of the ironing plate 200.

The iron protector includes a horizontal bar 232, which is positioned outside the iron rest so as to prevent the iron from escaping from the iron rest, and a pair of vertical bars 234, which are bent from the two ends of the horizontal bar 232 in a direction perpendicular thereto and which allow the horizontal bar 232 to be moved.

The pair of vertical bars 234 are connected at first ends thereof to the two ends of the horizontal bar 232, and are rotatably connected at the second ends thereof to the two side surfaces 226 of the ironing plate 200. The vertical bars 234 are rotated about rotational shafts 234*a* formed on the two side surfaces 226 of the ironing plate 200. As the vertical bars 234 are rotated, the position of the horizontal bar 232 is changed. Referring to FIG. 1, the horizontal bar 232 is positioned outside the iron rest in the ironing mode, thereby preventing the iron from escaping to the outside of the iron rest.

The iron protector 230 may hold a rear portion of a top, which is hung on the ironing plate 200, in the steam-spraying mode. The iron protector 230 holds a rear surface of a top, which is hung on the outer side of the ironing plate 200. The horizontal bar 232 is held on the clothing-ironing plate 212 in the steam-spraying mode, thereby holding a rear surface 228 of a top, which is hung on the ironing plate 200. The horizontal bar 232 may include a magnetic material. In the steam-spraying mode, the horizontal bar 232 is detachably attached to the clothing-ironing board 210 by virtue of the magnetic material.

The ironing plate 200 includes the rotational member 430, which is rotatably coupled to the body 100, a holding unit for holding a top, hung on the ironing plate 200, in the steam-spraying mode, and the spreading unit for tensioning the top hung on the ironing plate 200 in the steam-spraying mode. The clothing-ironing board 210 includes the rotational member 430, the holding unit and the spreading unit.

The rotational member 430 projects from the lower surface 225 of the ironing-plate case 222. The rotational member 430 is disposed at the upper portion of the body 100. The rotational member 430 is configured to have a shape complementary to the upper portion of the body 100 such that the rotational member 430 is rotatable at the upper portion of the body 100.

Referring to FIG. 7, the rotational member 430 is rotated about the rotational axis 252*a*, which is formed between the body 100 and the rotational member. The rotational member 430 includes a hinge shaft 432, which is rotated about the rotational axis 252*a*, and connecting bars 436 connecting the hinge shaft 432 to the ironing plate 200. The rotational member 430 further includes an angle-limiting member 440 for limiting rotation of the hinge shaft 432 and a button unit 450, which is operated in linkage with the angle-limiting member 440 so as to allow rotation of the hinge shaft 432.

The hinge shaft 432 is disposed in the cavities in the two locking bars 410. The hinge shaft 432 is rotated in the cavities in the locking bars 410. The connecting bars 436 are disposed at the two ends of the hinge shaft 432. The connecting bars 436 transmit the rotating force of the hinge shaft 432 to the ironing plate 200. When the hinge shaft 432 is rotated, the connecting bars 436 are rotated about the rotational axis 252*a*, thereby rotating the ironing plate 200. The connecting bars 436 are provided with the angle-limiting member 440 for limiting rotation of the hinge shaft 432.

The angle-limiting member 440 is rotated with the connecting bars 436. The locking bar 410 is provided with a plurality of locking grooves into which the angle-limiting member 440 is inserted. A part of the angle-limiting member 440 is inserted into one of the plurality of locking grooves formed in the locking bar 410, thereby locking the ironing plate 200. When the angle-limiting member 440 is inserted into one of the plurality of locking grooves in the locking bar 410, rotation of the hinge shaft 432 is limited.

Figure 8:
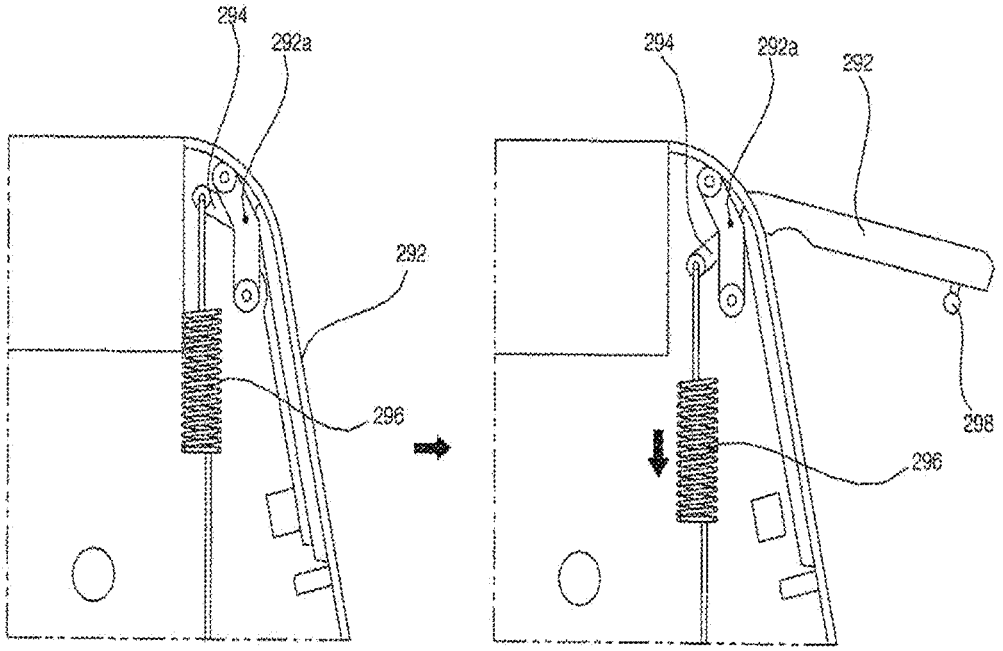
FIG. 8 is a view illustrating shoulder tensioners of the system iron according to an embodiment of the present invention.

The angle-limiting member 440 is operated in linkage with the button unit 450. Referring to FIGS. 2 and 8, in the ironing plate 200 according to the embodiment, when the button unit 450 is pushed, the angle-limiting member 440 is separated from the groove in the locking bar 410. When the button unit 450 is pushed by a user, the hinge shaft 432 is allowed to be moved.

The holding unit is a member for holding a top hung on the ironing plate 200 in the steam-spraying mode. The holding unit includes a magnetic material. The holding unit is detachably attached to the ironing plate 200 by virtue of the magnetic material. The holding unit includes a front press 260 for holding the front surface 227 of a top and the iron protector 230 for holding the rear surface 228 of the top.

The front press 260 serves to hold a top hung on the ironing plate 200 in the steam-spraying mode. The front press 260 is disposed under the lower surface 225 of the ironing plate 200 and extends in the longitudinal direction L of the ironing plate 200. The front press 260 brings the front surface of the top, hung on the ironing plate 200, into close contact with the lower surface 225 of the ironing plate 200 in the steam-spraying mode. The front press 260 brings the front surface of the top, hung on the outer side of the ironing plate 200, into close contact with the lower surface 225 of the ironing plate 200. The front press 260 is detachably attached to the lower surface 225 of the ironing plate 200 by virtue of the magnetic material. The detachable attachment of the front press using the magnetic material is merely one example, and another member, which functions to hold the front surface of the top between the lower surface of the ironing plate 200 and the front press 260, may also be used.

The magnetic force, which is created between the front press 260 and the ironing plate 200 so as to hold the front surface of the top hung on the outer side of the ironing plate, is set to be greater than the force exerted by the side tensioners 280 so as to spread the side surfaces of the top.

The front press 260 is disposed under the lower surface 225 of the ironing-plate case 222. The front press is hingedly coupled to the ironing plate 200 so as to be detachably attached to the lower surface of the ironing plate 200. The front press 260 is rotated about a press-plate hinge 264, which is provided at one side of the front press 260. The press-plate hinge 264 is disposed on the lower surface 225 of the ironing-plate case 222 so as to be positioned in front of and adjacent to the rotational member 430 in the longitudinal direction L of the ironing plate 200.

The front press 260 includes a press plate 262, which comes into contact with the ironing-plate case 222, and the press-plate hinge 264, which serves to hingedly couple the press plate 262 to the ironing plate 200. The press plate 262 comes into contact with the lower surface 225 of the ironing-plate case 222. The front press 260 is disposed adjacent to the rotational member 430 and extends in the longitudinal direction L of the ironing plate 200. The press-plate hinge 264 is disposed at the end of the front press 260 adjacent to the rotational member 430. The press-plate hinge 264 includes a rotational shaft 264*a*, which extends parallel to the cross direction W of the ironing plate 200 so as to allow the press plate 262 to be rotated thereabout.

A top, which is hung on the ironing plate 200, is disposed between the press plate 262 and the ironing-plate case 222. The top, which is hung on the ironing plate 200, is held between the press plate 262 and the ironing-plate case 222.

Figure 9:
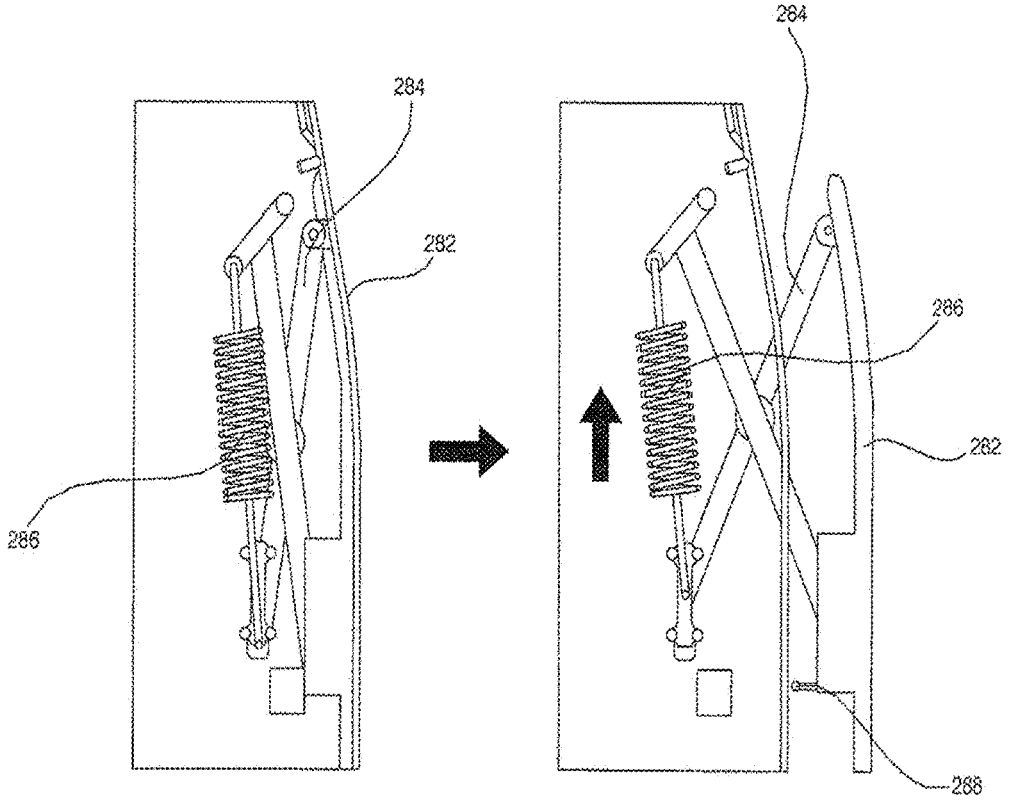
FIG. 9 is a view illustrating side tensioners of the system iron according to an embodiment of the present invention.

FIG. 8 is a view illustrating the shoulder tensioners of the system iron according to an embodiment of the present invention. FIG. 9 is a view illustrating the side tensioners of the system iron according to an embodiment of the present invention. Hereinafter, the side tensioners and the shoulder tensioners, which constitute the spreading unit, will be described with reference to FIGS. 8 and 9.

The spreading unit tensions a top, which is hung on the ironing plate 200, in order to eliminate wrinkles in the top. The spreading unit includes the side tensioners 280 for tensioning the right and left sides of the top and the shoulder tensioners 290 for holding shoulder portions of the top and for tensioning the same.

The side tensioners 280 and the shoulder tensioners 290 are intended to tension the right and left sides of the top and the two shoulder portions of the top. The side tensioners 280 are composed of a pair of right and left tensioners, and the shoulder tensioners 290 are composed of a pair of right and left tensioners, which are symmetrical with each other.

Referring to FIG. 9, the pair of side tensioners 280 uniformly tension the right and left sides of the top hung on the ironing plate 200 in order to eliminate wrinkles in the top. The pair of side tensioners 280 are disposed at the two side surfaces 226 of the ironing plate 200. Each of the pair of side tensioners 280 includes a side bar 282, which comes into contact with the inner surface of the top, a support member 284 for linearly moving the side bar 282 outwards from the ironing plate 200 in the cross direction W in a reciprocating manner, an elastic member 286 for exerting compressive force on the ends of the support member 284, and a one-touch click button 288 for holding the side bar 282 at the side surface 226.

The support member 284 according to the embodiment is configured to have an 'X' shape, and is vertically moved at first ends thereof by means of the elastic member, thereby moving the side bar 282 in the lateral direction of the ironing plate 200. The elastic member 286 according to the embodiment is embodied as a spring for exerting compressive force on the ends of the support member. The elastic member 286 may be replaced with any another member capable of exerting compressive force.

A user may release the locked state of the one-touch click button 288 by pushing the side bar 282. When the locked state of the one-touch click button 288 is released, the compressive force of the elastic member 286 is applied to the support member 284, and the side bar 282 is thus moved outwards from the side surface 226 of the ironing plate 200.

Referring to FIG. 8, the pair of shoulder tensioners 290 tension the two shoulder portions of the top. The shoulder tensioners 290 serve to enable the top to be stably hung on the ironing plate 200. The shoulder tensioners 290 are respectively rotated about hinge shafts 292*a*, which are formed at regions adjacent to the front surface 227 of the ironing plate 200. The pair of shoulder tensioners 290 are disposed at the two side surfaces 226 of the ironing plate 200 so as to be positioned at the front side in the longitudinal direction L of the ironing plate 200. The pair of shoulder tensioners 290 are spread from the two side surfaces 226 of the ironing plate 200 forwards in the longitudinal direction L of the ironing plate 200.

Each of the pair of shoulder tensioners 290 includes a hanger 292 for supporting the shoulder portions of the top hung on the outer side of the ironing plate, an elastic member 296 for spreading the hanger 292 outwards and forwards from the ironing plate 200, and a one-touch click button 298 for locking the hanger 292 so as to be held at the side surface 226 and for releasing the locked state of the hanger 292.

The hanger 292 is disposed at the front side of the side surface 226 of the ironing plate 200. The elastic member 296 exerts compressive force on the end of the hanger 292. The elastic member may be embodied by a member such as a spring.

The hanger 292 includes a hanger projection, which is bent at one end of the hanger 292 and extends to the inside of the ironing plate 200. The hanger projection 294 is connected at one end thereof to the hanger 292, and is connected at the other end thereof to the elastic member 296. The hanger projection 294 is provided between the two ends thereof with a hinge shaft 292*a*, about which the hanger 292 is rotated.

When a user pushes the lower portion of the hanger 292, the locked state of the one-touch click button 298 is released. When the locked state of the one-touch click button 298 is released, the other end of the projection of the hanger 292 is pulled by means of the compressive force of the elastic member 296. Due to the rotation of the hanger projection 294, the hanger 292 is projected outwards from the side surface 226. When the locked state of the one-touch click button 298 is released, the hanger 292 tensions the shoulder portions of the top hung on the ironing plate 200.

Figure 10:
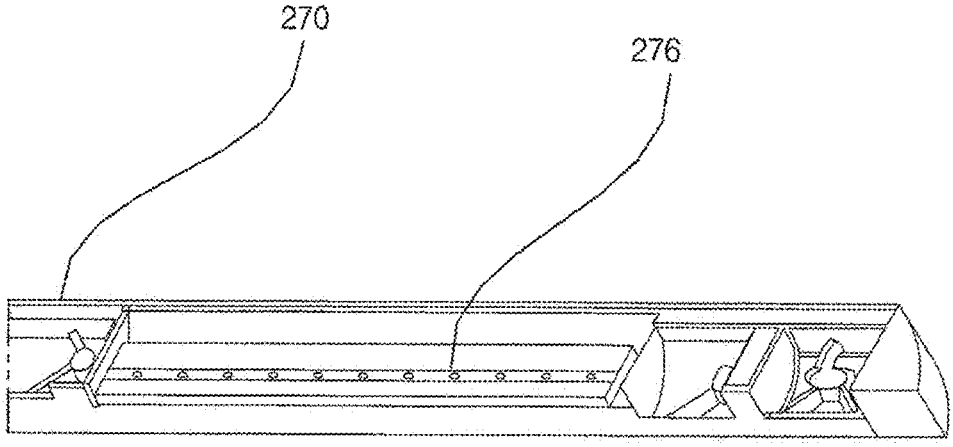
FIG. 10 is a view illustrating an arm tensioner including a sleeve-holding unit according to an embodiment of the present invention.

FIG. 10 is a view illustrating the arm tensioner including a sleeve-holding unit according to an embodiment of the present invention.

Hereinafter, the arm tensioners will be described. The pair of arm tensioners 270 serve to hold the two sleeve portions of the top hung on the ironing plate 200 and to tension the same in order to eliminate wrinkles in the two sleeve portions of the top. The arm tensioners 270 are also composed of a pair of tensioners, which are symmetrical to each other, so as to tension the two sleeves of the top. The arm tensioners 270 tension the sleeves of the top by pulling the sleeves of the top. The pair of arm tensioners 270 are disposed under the press plate 262 of the front press 260 in the height direction H of the ironing plate 200. When the press plate 262 is rotated about the press-plate hinge 264, the arm tensioners 270 are also rotated therewith. The arm tensioners 270 are rotated about the arm-tensioner hinges 274, thereby tensioning the sleeves of the top.

Each of the pair of arm tensioners 270 includes an arm-tension bar 272, which is hingedly coupled at one end thereof so as to be rotated on the lower surface of the ironing plate, and a sleeve-holding unit 276, which is disposed at the other end of the arm-tension bar so as to hold the sleeve of the top hung on the outer side of the ironing plate. The two rear ends of the pair of arm tensioners 270 are hingedly coupled to the lower surface of the front press 260, and the two front ends of the pair of arm tensioners 270 are rotated far away from each other.

The arm-tension bars 272 are rotated so as to tension the sleeves of the top. The arm tensioners 270 further include the arm-tensioner hinges 274, which allow the arm-tension bars 272 to be rotated.

The rotational shafts 274*a* of the arm-tensioner hinges 274 are configured so as to be perpendicular to the press plate 262. The rotational shafts 274*a* of the arm-tensioner hinges are configured so as to be perpendicular to the rotational shaft 264*a* of the press-plate hinge 264. Each of the arm-tension bars 272 is provided at one end thereof with the arm-tensioner hinge 274, and is provided at the other end thereof with the sleeve-holding unit 276. The pair of arm-tensioner hinges 274 allow the arm-tension bars 272 to be rotated such that portions thereof at which the sleeve-holding units 276 are positioned are moved far away from each other.

Figure 11:
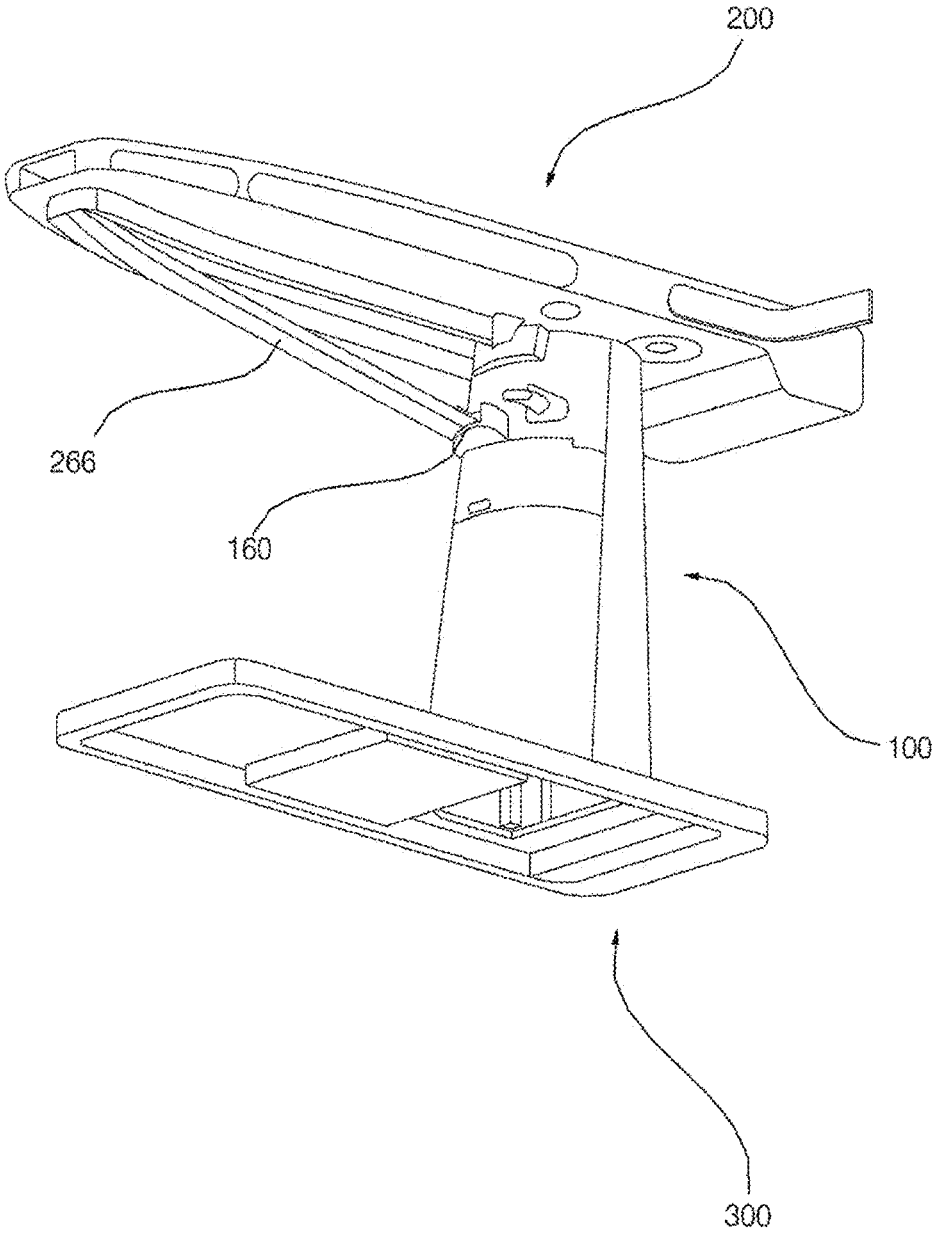
FIG. 11 is a bottom perspective view of the system iron according to an embodiment of the present invention, in which a support member is mounted on a support-leg mount.
Figure 12:
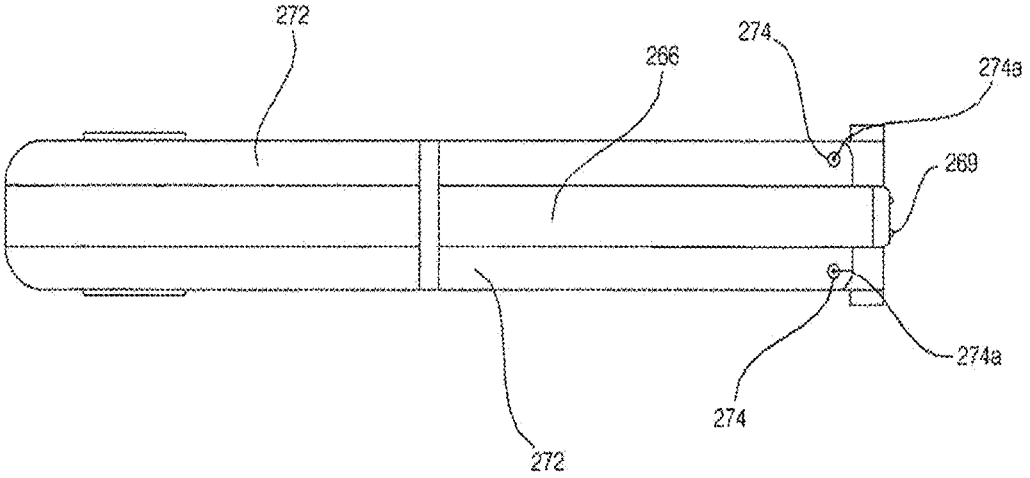
FIG. 12 is a view illustrating a front press, the arm tensioners and a support leg according to an embodiment of the present invention.
Figure 13:
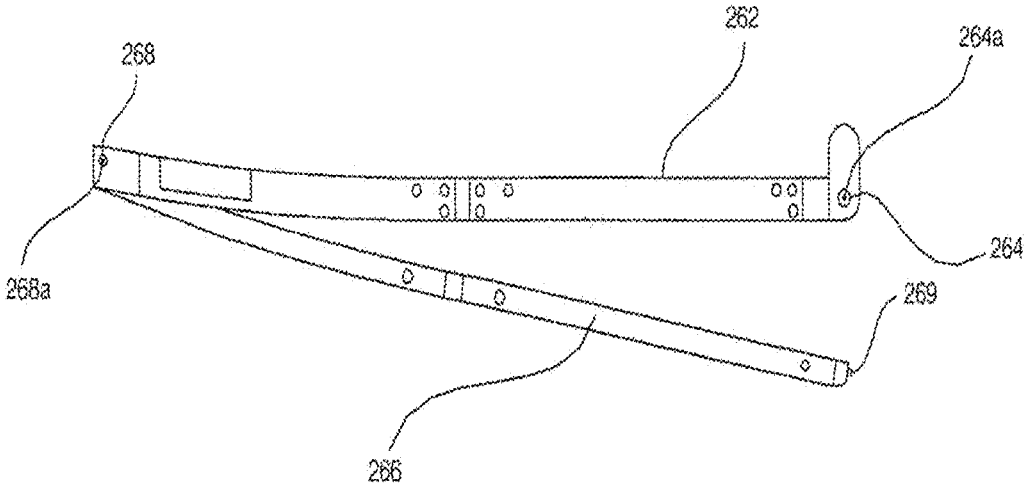
FIG. 13 is a view illustrating the front press, the arm tensioners and the support leg according to an embodiment of the present invention.

FIG. 11 is a bottom perspective view of the system iron according to an embodiment of the present invention, in which the support member is mounted on the support-leg mount. FIG. 12 is a view illustrating the front press, the arm tensioners and the support leg according to an embodiment of the present invention. FIG. 13 is a view illustrating the front press, the arm tensioners and the support leg according to an embodiment of the present invention.

The support unit according to the embodiment will be described with reference to FIGS. 11 to 13. The system iron according to the embodiment further includes the support unit for supporting the ironing plate 200 in the ironing mode. The support unit supports the ironing plate 200, which is vertically disposed on the body 100, in the ironing mode. The support unit supports the lower surface 225 of the ironing-plate case 222 in the ironing mode. The support unit connects the lower surface 225 of the ironing-plate case 222 and the support-leg mount formed on a side surface of the upper body 110 in the ironing mode. The support unit supports the clothing-ironing board 210 of the ironing plate 200.

The support unit includes the support leg 266, which supports the ironing plate 200 in the ironing mode, and a support-leg hinge 268, which enables the support leg 266 to be rotated. The support leg 266 is disposed under the press plate 266 of the front press 260 in the height direction H of the ironing plate 200. The support leg 266 according to the embodiment is disposed between the pair of arm tensioners 270. The support-leg hinge 268 is disposed at the front side of the support leg 266 in the longitudinal direction L of the ironing plate 200.

The arm tensioners 270 and the support unit are disposed under the front press 260. When the press plate 262 is rotated about the press-plate hinge 264, the support plate and the arm-tension bars 272 are also rotated with the press plate 262. When the support plate is rotated about the support-plate hinge, the press plate 262 and the arm-tension bars 272 are not rotated. The arm-tension bars 272 are rotated about the arm-tensioner hinges 274, but the press plate 262 or the support plate are not rotated.

The end of the support leg 266 is mounted in the mounting recess 162 in the support-leg mount 160. The support leg 266 includes the holding pins 269, which movably project from the end thereof. The holding pins 269 project outwards from the support leg 266 by virtue of the elastic force of springs disposed in the support leg. When external pressure is applied to the holding pins 269, the holding pins 266 may be moved into the support leg 266.

When the support leg 266 is mounted on the support-leg mount 160, the holding pins 269 are inserted into the holding holes (not shown) in the support-leg mount 160, whereby the support leg 266 is stably held on the support-leg mount 160.

The ironing plate 200 includes the neck clip 299, which holds the collar portion of the top in the steam-spraying mode. The neck clip 299 is disposed at the front surface 227 of the ironing plate 200. The neck clip 299 is drawn out of the ironing plate 200 forwards in the longitudinal direction L or is retracted into the ironing plate 200.

The system iron 10 according to the embodiment may further include a base plate 300 for supporting the body 100 and the ironing plate 200. The base plate 300 has a size and a weight such that the ironing plate 200 is stably secured on the body 100 both in the ironing mode and in the steam-spraying mode.

The base plate 300 may further include casters (not shown), which enable the system iron 10 to be easily moved.

Figure 14:
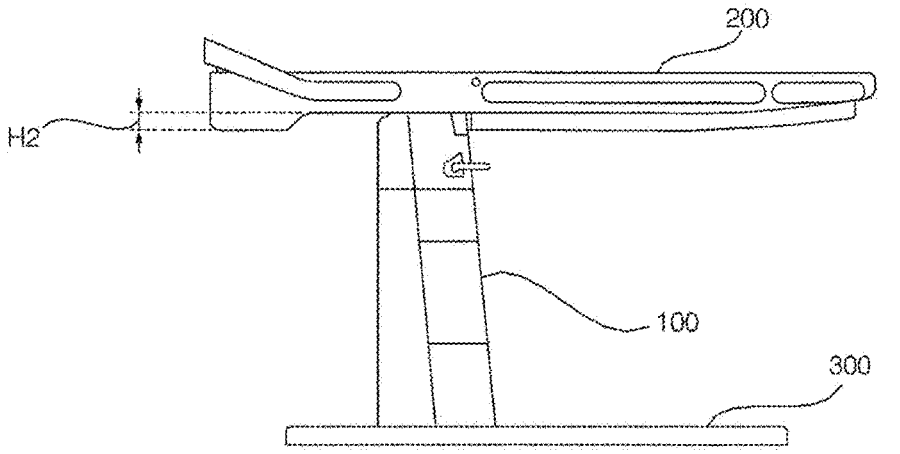
FIG. 14 is a view illustrating the position of the ironing plate of the system iron according to an embodiment of the present invention in an ironing mode and a steam-spraying mode.
Figure 14:
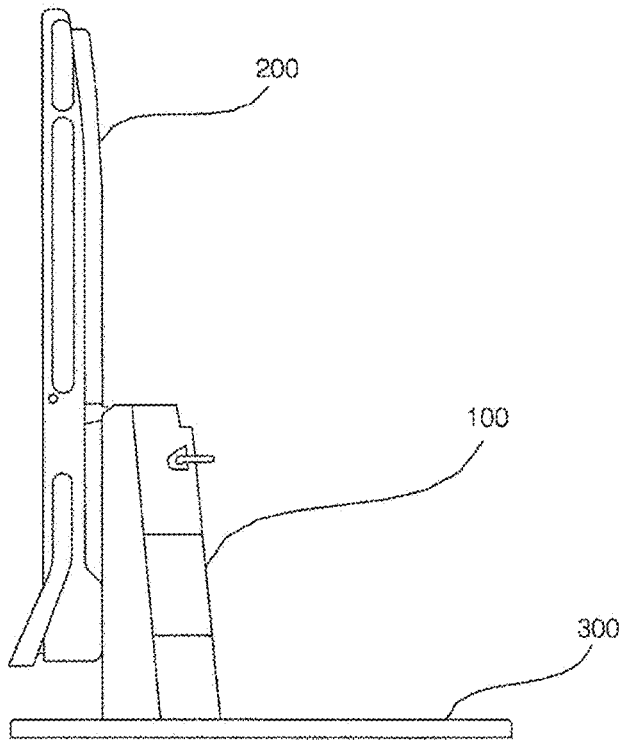
Figure 15:
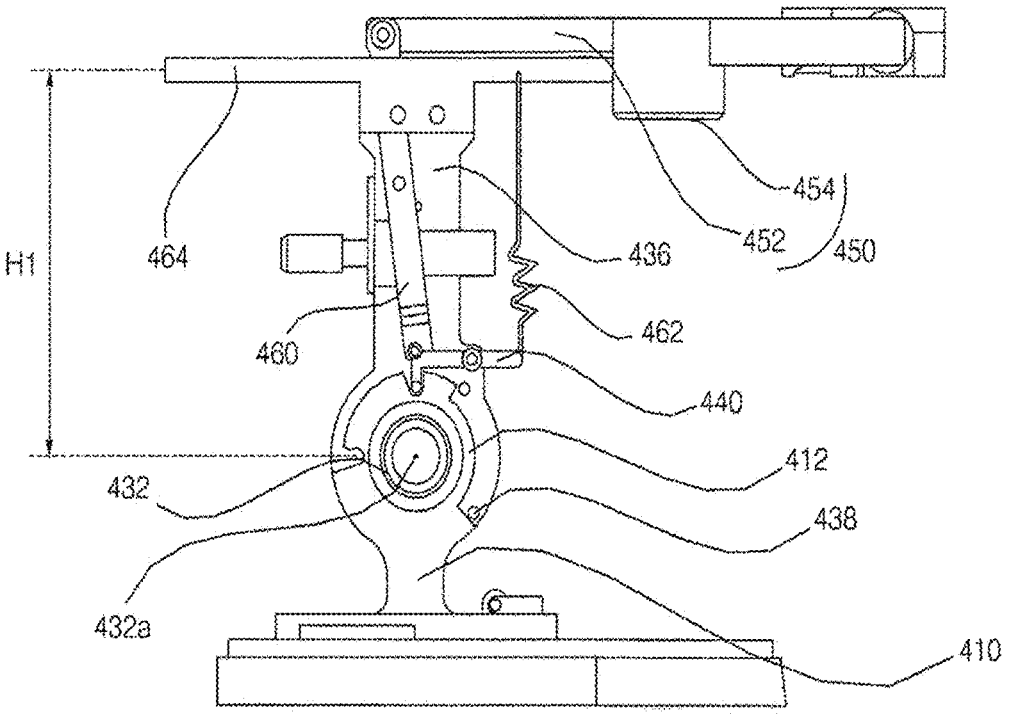
FIG. 15 is a view illustrating the angle-limiting member of the system iron according to an embodiment of the present invention.
Figure 16:
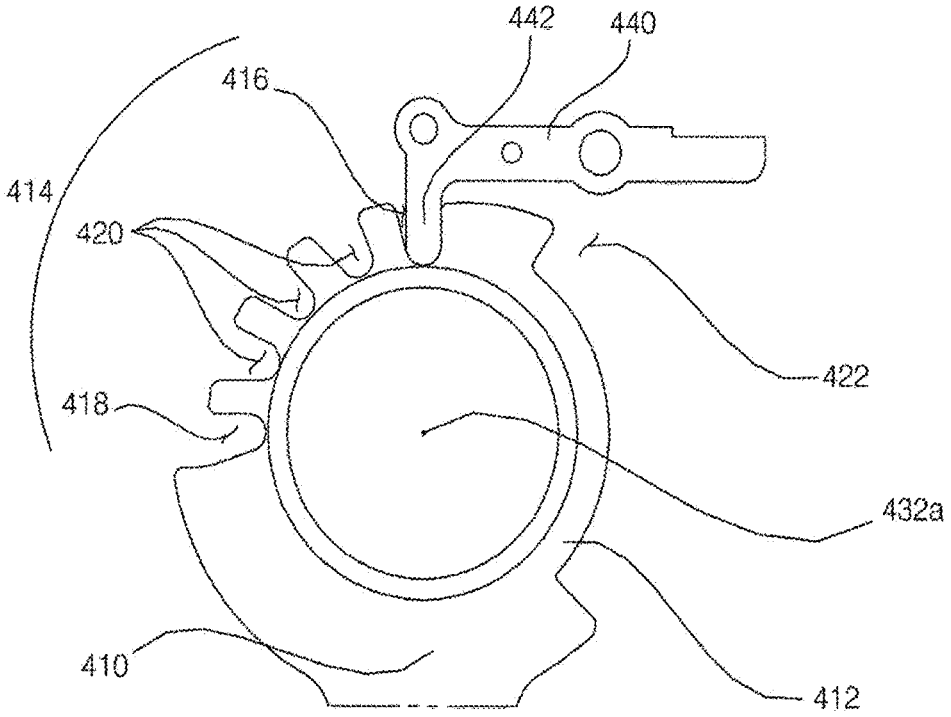
FIG. 16 is a view illustrating a locking ring of the locking bars according to another embodiment of the present invention.
Figure 17:
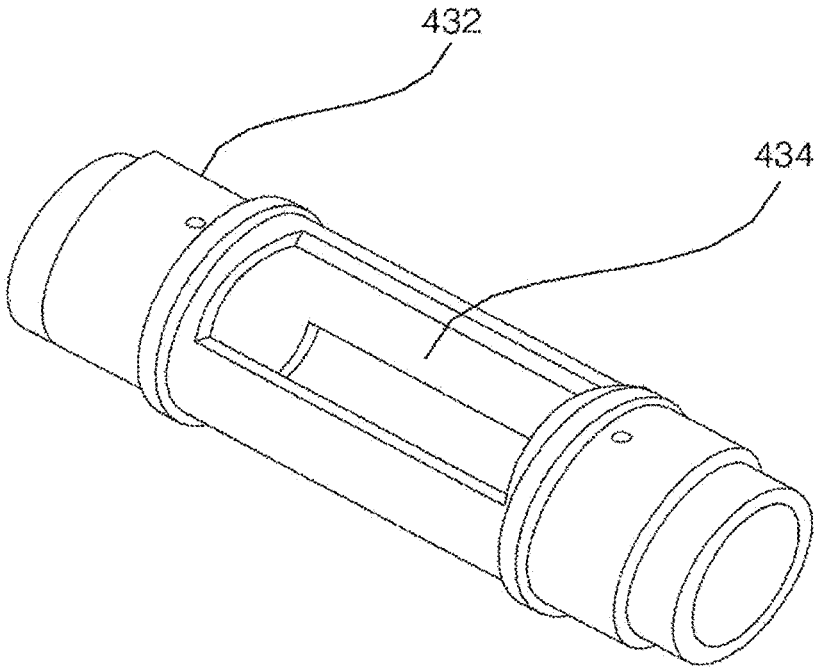
FIG. 17 is a perspective view of the hinge shaft according to an embodiment of the present invention.
Figure 18:
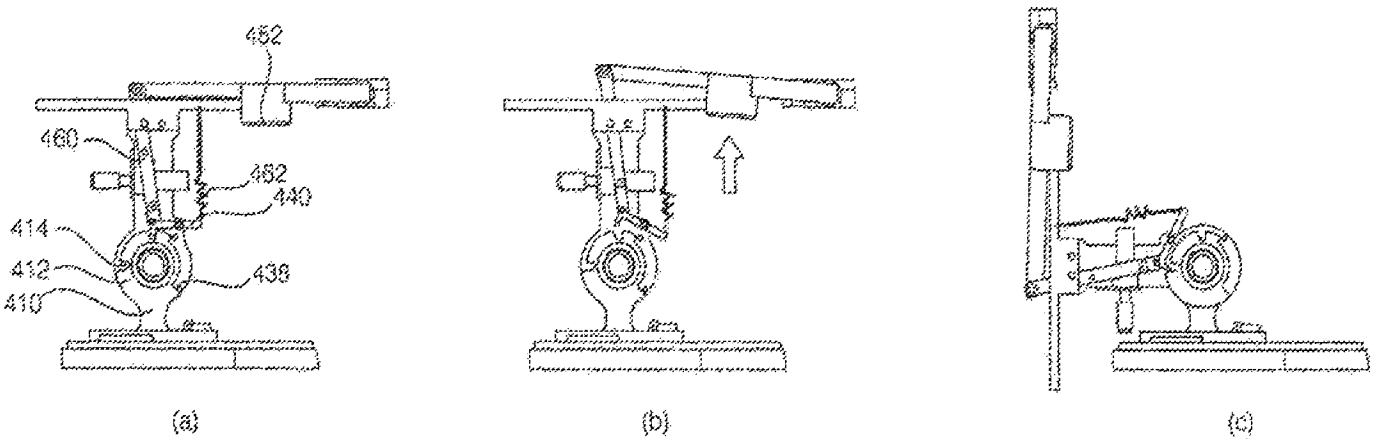
FIG. 18 is a view illustrating the operation of the angle adjustment unit according to an embodiment of the present invention, in which (a) illustrates the state in which the locked state of the angle-limiting member is maintained, (b) illustrates the state in which the locked state of the angle-limiting member is released, and (c) illustrates the state in which the ironing plate is rotated after the locked state of the angle-limiting member is released.

FIG. 14 is a view illustrating the position of the ironing plate of the system iron according to an embodiment of the present invention in the ironing mode and the steam-spraying mode. FIG. 15 is a view illustrating the angle-limiting member of the system iron according to an embodiment of the present invention. FIG. 16 is a view illustrating a locking ring of the locking bars according to another embodiment of the present invention. FIG. 17 is a perspective view of the hinge shaft according to an embodiment of the present invention. FIG. 18 is a view illustrating the operation of the angle adjustment unit according to an embodiment of the present invention.

The system iron according to the embodiment includes the angle adjustment unit 400 for adjusting the angle of the ironing plate 200 coupled to the upper portion of the body 100. Referring to FIG. 14, the system iron 10 according to the embodiment is configured such that the position of the ironing plate 200 coupled to the upper portion of the body 100 is changed. The ironing plate 200 is rotatably coupled to the upper portion of the body. The position of the ironing plate 200 is changed depending on the operational mode.

The system iron 10 according to the embodiment includes the body 100 including therein the steam generator for generating steam; the ironing plate 200, which is rotatably connected to the upper portion of the body and which sprays the steam generated by the steam generator to the outside; the angle-limiting member 440 for limiting the rotation of the ironing plate 200; the button unit 450, which is operated in linkage with the angle-limiting member 440 so as to release the rotational restriction of the ironing plate 200 by the angle-limiting member 440; and an elastic member 462 for maintaining the rotational restriction of the ironing plate 200 by the angle-limiting member 440.

The system iron 10 according to the embodiment includes the hinge shaft 432 for allowing the ironing plate to be rotatably coupled to the upper portion of the body; the connecting bars 436 connecting the hinge shaft to the ironing plate; and the locking bars 410, which are disposed on the body so as to support the rotation of the hinge shaft and which have formed therein locking grooves into which the angle-limiting member is inserted.

The system iron 10 according to the embodiment includes the body 100 including the steam generator for generating steam; the ironing plate 200, which is rotatably connected to the upper portion of the body 100 so as to be changed in position depending on whether the system iron is operated in an ironing mode, in which an ironing operation is performed, or in a steam-spraying mode, in which the steam is sprayed to a top; the angle-limiting member 440 for maintaining the position of the ironing plate in the ironing mode or in the steam-spraying mode; the button unit 450 for allowing the position of the ironing plate in the ironing mode or in the steam-spraying mode to be changed; and the elastic member 462, which is connected to the angle-limiting member so as to maintaining the position of the ironing plate in the ironing mode or in the steam-spraying mode.

The body 100 supports the rotation of the ironing plate 200 at the upper portion. The body 100 is rotatably coupled to the ironing plate 200. The upper portion of the body 100 is configured to have a shape complementary to the shape of the ironing plate 200.

The body 100 includes two locking bars 410 for supporting the rotation of the hinge shaft 432. The locking bars 410 are disposed on the upper body 110. Each of the locking bars 410 includes therein a circular cavity in which the hinge shaft 432 is disposed.

The locking bars 410 project from the upper portion of the upper body 110. Each of the locking bars 410 is provided at the end thereof with the locking ring 412, which has a hollow cavity so as to enable the end thereof to be coupled to the hinge shaft 432. The hinge shaft 432 is disposed on the inner periphery of the locking ring 142. The locking ring 412 is provided in the outer periphery thereof with the locking grooves 414 into which the angle-limiting member 440 is inserted. Furthermore, The locking ring 412 is provided in the outer periphery thereof with a stopper groove 422 for limiting the range of motion of a stopper 438 projecting from a portion of the connecting bar.

The locking ring 412 is provided in the outer periphery thereof with at least two locking grooves 414, which are disposed within an angular range of 90 degrees in which the rotational member of the ironing plate 200 is rotated. The locking grooves 414 include an ironing-mode-locking groove 416, which is formed at a point on the locking ring corresponding to the position of the ironing plate in the ironing mode, and a steam-spraying-mode-locking groove 418, which is formed at a point on the locking ring corresponding to the position of the ironing plate in the steam-spraying mode.

Referring to FIG. 16, the locking ring of the system iron according to another embodiment of the present invention may include at least one additional locking groove 420, which is formed between the ironing-mode-locking groove 416 and the steam-spraying-mode-locking groove 418. The additional locking groove 420 enables the ironing plate to be maintained at an inclined state on the body.

The stopper groove 422 limits the rotational range of the ironing plate 200. The stopper groove 422 limits the rotational range of the stopper 438 formed at a portion of the connecting bar 436. The stopper groove 422 prevents the ironing plate 200 from being rotated beyond the range of the locking grooves 414 formed in the outer periphery of the locking ring 412. The stopper groove 422 is formed so as to define an angular range corresponding to the angular range between the ironing-mode-locking groove 416 and the steam-spraying-mode-locking groove 418 formed in the locking ring.

The rotational member 430 allows the ironing plate 200 to be rotated on the body 100. The rotational member 430 includes the hinge shaft 432, which rotates in the cavities in the locking bars, and the connecting bars 436, which are connected to the hinge shaft 432 so as to allow the ironing plate to be rotated. The rotational member 430 according to the embodiment further includes a lower frame 464, which is disposed inside the lower surface of the ironing plate so as to allow the entire ironing plate 200 to be rotated by the rotation of the connecting bars 436.

The hinge shaft 432 is disposed in the cavities in the locking bars 410. The connecting bars 436 are connected to the two ends on the outer periphery of the hinge shaft 432. Referring to FIG. 17, the hinge shaft 432 is configured to have a hollow cylindrical shape.

The hinge shaft 432 is rotated about an internal hollow axis 432*a*. The hinge shaft 432 is configured to have therein a cavity and to have an opening in at least one of the two ends thereof. The hinge shaft 432 may also be open at both ends thereof. Since the open end of the hinge shaft 432 is formed on the rotational axis 432*a*, the steam flow channel is maintained in the same position regardless of the rotation of the hinge shaft 432.

A flow through hole 434 is formed in a zone on the peripheral surface of the hinge shaft 432. The flow through hole 434 faces upwards in the height direction H of the ironing plate 200. The flow through hole 434 opens in the direction in which the connecting bars 436 are connected to the hinge shaft 432.

When the hinge shaft 432 is rotated, the flow through hole 434 is also rotated therewith. Since the hinge shaft 432 is rotated together with the ironing plate 200 by means of the connecting bars 436, the flow through hole 434 is maintained in the state of facing upwards in the height direction of the ironing plate 200 even when the ironing plate 200 is rotated.

The steam flow channel 244 extends through the open end of the hinge shaft 432 and the flow through hole 434.

The steam flow channel 244 is stably connected through the hinge shaft 432 even when position of the ironing plate 200 on the body 100 is changed depending on the ironing mode or the steam-spraying mode.

The connecting bars 436 are connected at first ends thereof to the hinge shaft 432. The connecting bars 436 are rotated together with the hinge shaft 432. The connecting bars 436 are connected at second ends thereof to the lower frame 464. When the hinge shaft 432 is rotated, the iron plate 200 is rotated by means of the connecting bars 436. The length of the connecting bars 436 may be designed in consideration of the structure of the lower surface of the ironing plate 200. Referring to FIG. 14(*a*), the rear side of the ironing plate, in the longitudinal direction of the ironing plate, projects downwards in the height direction of the ironing plate in consideration of the second fan. In this regard, the length H1 of the connecting bars 436 may be designed in consideration of the height H2 of the rear portion of the ironing plate, which projects due to the second fan.

The angle-limiting member 440 for limiting the rotation of the hinge shaft 432 is connected to one end of the connecting bar 436. The angle-limiting member 440 is hingedly connected to the connecting bar. The connecting bar 436 is hingedly connected to a point on the angle-limiting member 440 between one end thereof, at which a locking projection 442, which is inserted into the locking hole 414, is formed, and the other end thereof, to which the elastic member 462 is connected. The elastic member 462 according to the embodiment is preferably embodied as a spring for lifting the one end of the angle-limiting member 440.

The angle-limiting member 440 is inserted at one end thereof into the locking groove 414 and is connected at the other end thereof to the elastic member 462. The one end of the angle-limiting member 440 is provided with the locking projection 442, which is inserted into the locking groove 414 in the locking bar 410. The locking projection 442 is bent at the one end of the angle-limiting member 440. When the locking projection 442 of the angle-limiting member 440 is inserted into the locking groove 414, the rotation of the hinge shaft 432 is limited. When the locking projection 442 of the angle-limiting member 440 is inserted into the locking groove 414, the rotation of the ironing plate 200 is limited.

The other end of the angle-limiting member 440 is connected to the elastic member 462. The elastic member 462 connects the angle-limiting member 440 to the lower frame 464. The elastic member 462 applies upward compressive force to the other end of the angle-limiting member 440 in the height direction of the ironing plate 200.

The angle-limiting member 440 is hingedly connected at a portion between the one end and the other end thereof to the connecting bar 436. Accordingly, the locking projection 442 of the angle-limiting member 440 is maintained in the state of being received in the locking groove 414 in the locking bar 410, as long as no additional force is applied to the angle-limiting member 440.

The angle adjustment unit 400 according to the embodiment includes the button unit 450 for moving the locking projection 442 of the angle-limiting member 440. The angle adjustment unit 400 according to the embodiment includes an angle-limiting-unit release 460 connecting the button unit 450 to the angle-limiting member 440. The button unit 450 lifts the one end of the angle-limiting member 440, at which the locking projection 442 is formed, by means of the angle-limiting-unit release 460, which is connected to one side of the angle-limiting member 440.

The button unit 450 includes a button bar 452, which is connected at one end thereof to the angle-limiting-unit release 460 and is hingedly connected at the other end thereof to a lower portion of the ironing plate 200, and a button 454, which projects downwards from a point between the one end and the other end of the button bar in the height direction of the ironing plate.

Referring to FIG. 15, one end of the button bar 452 of the button unit 450 is connected to the angle-limiting-unit release 460. When a user applies pressure to the button 454, the button bar 452 is rotated about the hinge formed at the other end thereof, and the locking projection 442 of the angle-limiting member 440 connected to the angle-limiting-unit release 460 is moved upwards. When the angle-limiting member 440 is lifted, the rotation of the hinge shaft 432 is allowed, thereby enabling the angle of the ironing plate 200 to be adjusted.

Hereinafter, the operation of the angle adjustment unit 400 will be described with reference to FIG. 18. As long as additional force is not applied to the button unit 450 of the angle-limiting member 400, the locking projection 410 of the angle-limiting member 440 is received in the locking groove 414 and the ironing plate 200 is thus maintained at the angle on the body 100, as illustrated in FIG. 18(*a*).

The locking projection 442 of the angle-limiting member 440 is maintained in the state of being received in the locking groove 414 by virtue of the elastic force of the elastic member 462.

When pressure is applied to the button 454 of the button unit 450, as illustrated in FIG. 18(*b*), the button bar 452 is rotated about the hinge at the other end thereof. The button bar 452 lifts the locking projection of the angle-limiting member 440 via the angle-limiting-unit release 460, thereby releasing the locked state of the angle adjustment unit 400. When the locked state of the angle adjustment unit is released, the hinge shaft is rotated, thereby enabling the angle of the ironing plate to be adjusted.

Accordingly, the angle of the ironing plate 200 may be adjusted, as illustrated in FIG. 18(*c*). After the angle of the ironing plate 200 is adjusted, the locking projection 442 of the angle-limiting member 440 is inserted into a desired locking groove 414, which is formed in the locking bar 410, thereby maintaining the changed angle of the ironing plate 200.

The invention claimed is:

1. A system iron comprising:

a body including a steam generator for generating steam;

an ironing plate, which is rotatably coupled to an upper portion of the body and which sprays the steam generated by the steam generator to an outside;

an angle-limiting member for limiting rotation of the ironing plate;

a button unit, which is operated in linkage with the angle-limiting member so as to release a state in which rotation of the ironing plate is limited by the angle-limiting member;

an elastic member for maintaining the state in which rotation of the ironing plate is limited by the angle-limiting member;

a hinge shaft connecting the ironing plate to the upper portion of the body in a rotatable manner;

a connecting bar connecting the hinge shaft to the ironing plate; and a locking bar, which is disposed on the body so as to support rotation of the hinge shaft and which has formed therein a locking groove into which the angle-limiting member is inserted, wherein the angle-limiting member is inserted at one end thereof into the locking groove in the locking bar and is connected at a remaining end thereof to the elastic member.

2. The system iron according to claim 1, wherein the angle-limiting member is hingedly coupled to the connecting bar.

3. The system iron according to claim 1, wherein the locking bar includes at one end thereof a locking ring having a hollow cavity so as to be connected to the hinge shaft, and the locking ring is provided in an outer periphery thereof with a plurality of locking grooves into which a portion of the angle-limiting member is inserted.

4. The system iron according to claim 3, wherein the locking ring includes, in an outer periphery thereof:

an ironing-mode-locking groove into which the locking projection of the angle-limiting member is inserted in an ironing mode using an iron; a steam-mode-locking groove into which the locking projection of the angle-limiting member is inserted in a steam-spraying mode using a steam; and at least one additional locking groove provided between the ironing-mode-locking groove and the steam-spraying-mode-locking groove.

5. The system iron according to claim 1, wherein the locking bar includes a stopper groove for limiting a range of motion of a stopper projecting from a portion of the connecting bar.

6. The system iron according to claim 1, further comprising an angle-limiting-member release connected to the button unit so as to release the state in which rotation of the ironing plate is limited by the angle-limiting member.

7. The system iron according to claim 1, further comprising an angle-limiting-member release connecting the button unit to the angle-limiting member, wherein the button unit includes:

a button bar, which is connected at one end thereof to the ironing plate and at a remaining end thereof to the angle-limiting-member release; and a button projecting downwards from a portion between the one end and the remaining end of the button bar.

8. A system iron comprising:

a body including a steam generator for generating steam;

an ironing plate, which is rotatably connected to an upper portion of the body so as to be changed in position depending on whether the system iron is operated in an ironing mode, in which an ironing operation is performed, or in a steam-spraying mode, in which the steam is sprayed to a top;

an angle-limiting member for maintaining a position of the ironing plate in the ironing mode or in the steam-spraying mode;

a button unit for allowing the position of the ironing plate in the ironing mode or in the steam-spraying mode to be changed;

an elastic member, which is connected to the angle-limiting member so as to maintaining the position of the ironing plate in the ironing mode or in the steam-spraying mode;

a hinge shaft connecting the ironing plate to the upper portion of the body in a rotatable manner;

a connecting bar connecting the hinge shaft to the ironing plate; and a locking bar, which is disposed on the body so as to support rotation of the hinge shaft and which has formed therein a locking groove into which the angle-limiting member is inserted, wherein the angle-limiting member is inserted at one end thereof into the locking groove in the locking bar and is connected at a remaining end thereof to the elastic member.

* * * * *